United States Patent [19]

Provost

[11] Patent Number: 4,497,077

[45] Date of Patent: Feb. 5, 1985

[54] PORTABLE BASIN APPARATUS

[75] Inventor: Alfred M. Provost, Feeding Hills, Mass.

[73] Assignees: Anthony J. Izzo, Westport, Conn.; Orlin Sutter, West Springfield, Mass.

[21] Appl. No.: 496,419

[22] Filed: May 20, 1983

[51] Int. Cl.[3] ..... A47K 5/00; A47K 5/702

[52] U.S. Cl. ..... 4/628; 4/596; 4/627; 248/156

[58] Field of Search ..... 4/661, 628, 619, 627, 4/602, 596, 603, 605; 248/146, 156, 155, 150

[56] References Cited

U.S. PATENT DOCUMENTS

| | | | |
|---|---|---|---|
| 2,520,450 | 8/1950 | Austin, Jr. | 248/156 X |
| 2,603,440 | 7/1952 | Vesconte et al. | 248/156 X |
| 3,076,557 | 2/1963 | Husted et al. | 248/156 X |
| 3,720,963 | 3/1973 | Zakaski | 4/628 |
| 3,995,796 | 12/1976 | Kline | 248/156 X |
| 4,096,951 | 6/1978 | Menssen | 248/156 X |

*Primary Examiner*—Henry K. Artis
*Attorney, Agent, or Firm*—William G. Rhinrs

[57] ABSTRACT

This invention relates to portable wash stands, and in one embodiment comprises a base member with an upright support affixed to it and a basin support affixed to the top of the upright. The basin support comprises a semi-circular, upward facing member to the topmost ends of which is rotatably affixed a circular basin support. Means are provided to retainably position the circular basin support with respect to the semi-circular member. By this means, the basin support ring may be rotated into a co-planar orientation with respect to the semi-circular member for compact storage, or with the plane of the ring at right angles to the plane of the semi-circular member to support a circular wash basin with its center at the line of the axis of the upright.

10 Claims, 5 Drawing Figures

Fig. 1.
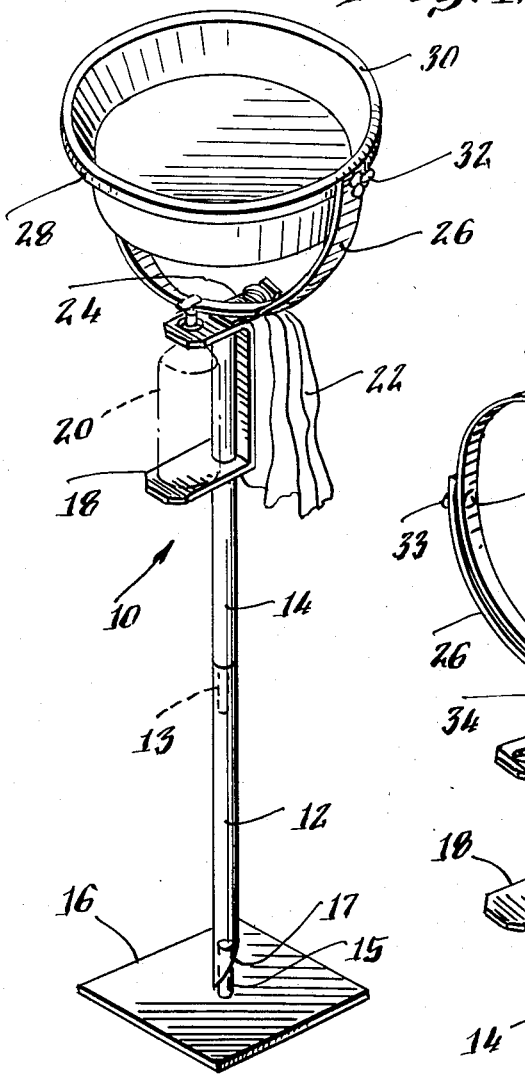
Fig. 2.
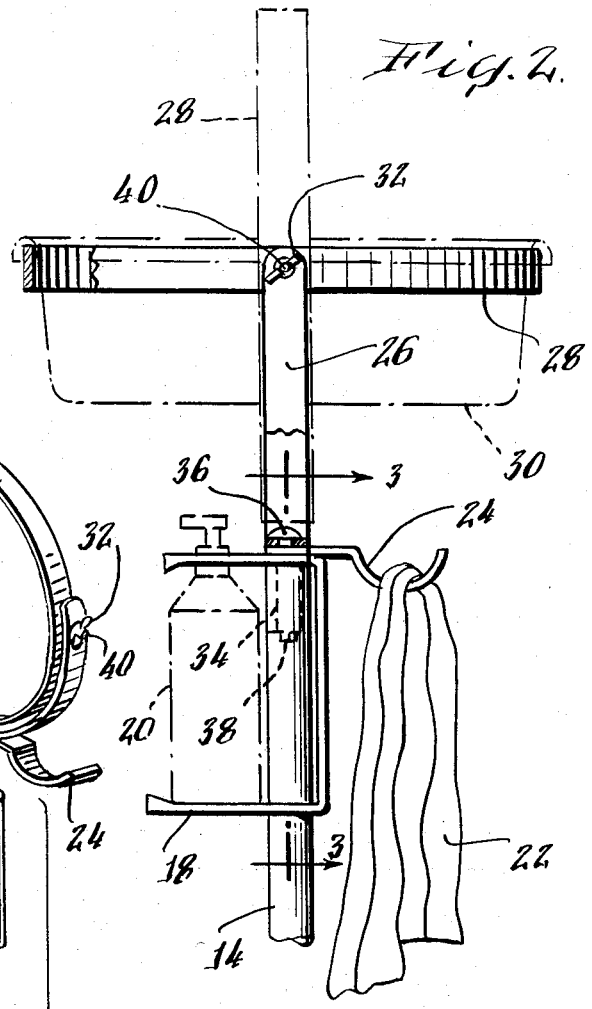
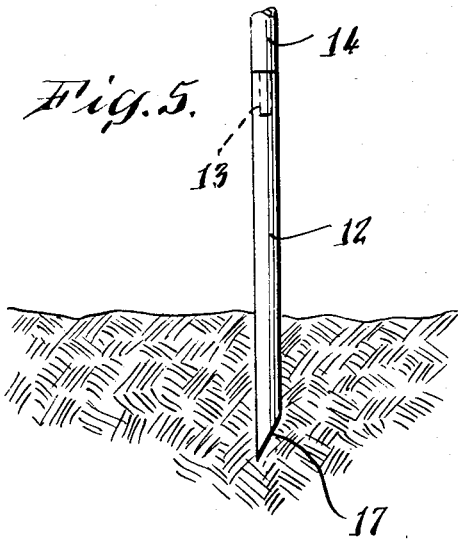
Fig. 5.
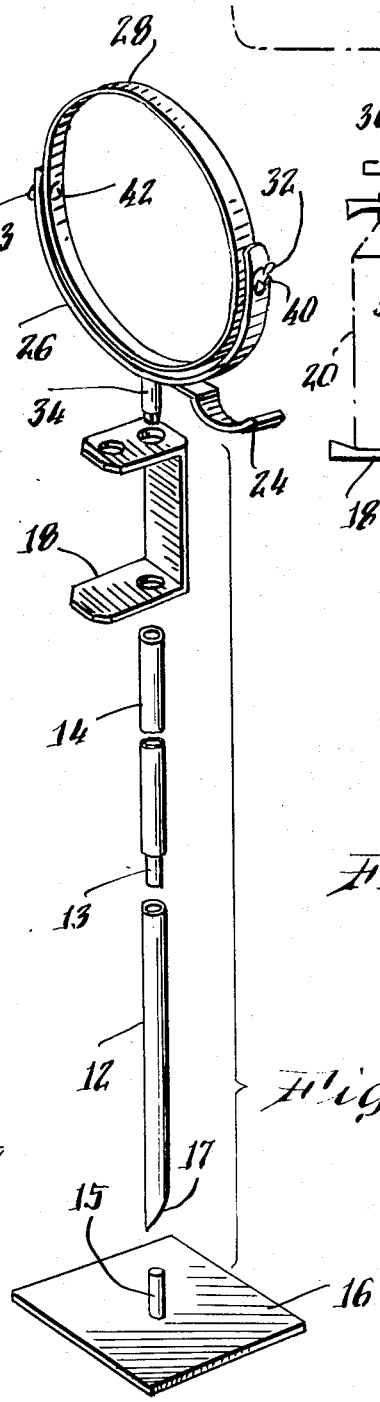
Fig. 4.
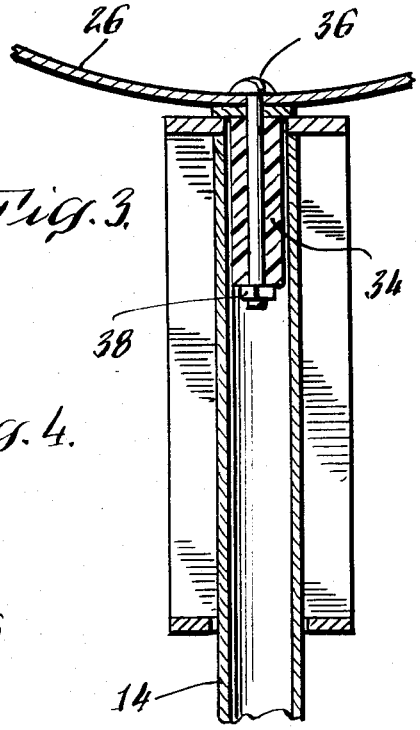
Fig. 3.

PORTABLE BASIN APPARATUS

BACKGROUND OF THE INVENTION

This invention relates to the field of portable wash-stand devices that are easily packed, transported, and set up, such as for outdoor camping, performing auto repairs, etc. Various attempts have been made to meet the need for such devices. In this connection, reference is made to U.S. Pat. Nos. 3,018,490 (Eichorst), 3,720,963 (Zakaski), 3,828,373 (Fraley), andk 4,096,951 (Menssen).

Prior art devices in this field have attempted to incorporate features which enhance portability, as, for example, by providing an assemblage of component elements which may be "broken down" when not in use to facilitate the unit being packed in a compact and space-saving manner. Recognizing the advantages of not having to totally dis-assemble components in order to achieve compact packing, other prior art devices (e.g., Eichorst U.S. Pat No. 3,018,490) have disclosed the use of a basin holding ring, pivotally mounted at one point to the top of an upright support member. Such devices, however, are inherently unstable, since the support ring is supported at one point on its periphery in order to facilitate swiveling. This makes it difficult to keep the unit upright as weight (i.e., of water) is added to the basin positioned within the ring. It may, in fact, make stability virtually impossible where the unit is being used on a hard surface, such as a concrete garage floor, that is not readily penetrated by a spear-like upright of the type shown in the above-mentioned Zakaski, Fraley and Menssen patents. Apparently recognizing the desirability of imparting stability to inhibit the weighted bowl and its associated support post from topling over, the Zakaski and Fraley references (See Col. 1, lines 20–22) disclose portable wash units in which the wash bowl is centered to the axis of its associated support post. However, these devices as disclosed necessitate total dis-assembly for packing and transportation; a drawback which is time-consuming and inconvenient, and risks the loss of misplacement of essential components of the assembly.

According, it is an object of this invention to provide a portable wash-stand apparatus.

It is a further object of this invention to provide such apparatus in a form which may be positioned on a variety of surfaces while exhibiting positional stability.

Yet another object of this invention is to provide means to achieve the foregoing objectives with apparatus that may be easily set up for use, and adjust for being transported.

Still another object is to provide means which will satisfy the foregoing objectives and may be transported in a form which is compact, and does not involve the dis-assembly of component parts.

SUMMARY OF INVENTION

Desired, objectives may be achieved through practice of the present invention, embodiments of which include portable wash-stand apparatus having a vertical support member to the top of which is affixed an upward-facing open-topped support yoke, which may be a portion of regularly arcuate geometric shape such as a semi-circle, to the top of the arms of which is pivotally mounted a basin support ring of closed configuration, which may be a regular arcuate geometric shape such as a circle of dimensions corresponding to that of the support yoke.

DESCRIPTION OF DRAWINGS

This invention may be understood from the description which follows and from the accompanying drawings in which FIG. 1 is a perspective view of an embodiment of this invention, FIG. 2 illustrates a cross-section of a portion of the embodiment of this invention shown in FIG. 1, FIG. 3 illustrates a cross-section take along line 3—3 as shown in FIG. 2, FIG. 4 is an exploded perspective view of the embodiment of this invention shown in FIGS. 1, 2 and 3, and FIG. 5 is a cross-section of a portion of the embodiment of this invention shown in FIGS. 1 through 4, illustrating an alternative mounting means.

DESCRIPTION OF PREFERRED EMBODIMENTS

Referring first to FIG. 1, there is depicted a wash stand apparatus 10 which embodies the present invention. It comprises a support base in the form of a vertically oriented pole structure. The support base is shown in FIG. 1 as a plurality of tube segments 12, 14 which may be removeably joined together by means of a mounting pin 13 which is affixed to the segment 14 and may be inserted into the interior of bottom segment 12. This is a preferred structure for reasons of ease in production and storage. However, it will be apparent that it is within the contemplation of this invention that the support base may take any of a wide variety of other configurations as well. These include a single segment for the entire length of the support, or more than two segments, any of which may have square, angular, rectangular, or other cross-sectional shapes. There may be provided a flat, plate-like base member 16 having a vertically oriented mounting pin 15 which is dimensioned and configured to provide a wobble-free support for the bottom segment 12 of the support pole when it is positioned atop the plate 16 with the pin 15 inside the base of the segment 12. This arrangement is suited for use on surfaces, such as a garage floor, which are hard yet relatively flat. Alternatively, as shown in FIG. 5, this embodiment may be mounted in operating position by driving the lower end 17 of the lower segment 12 directly into the earth. This alternative is facilitated by the lower end 17 of the lower segment 12 having been cut at an angle.

Optionally, as shown in FIGS. 1 through 4, a soap dispenser holder 18 may be positioned at the top end of the top segment 14, to hold a dispenser of soap 20 or a soap dish (not shown).

Another desirable option is a towel holder 24 which may be affixed to the vertical support as shown, to hold a towel 22.

The soap dispenser holder 18 and/or the towel holder 24, if either or both are used, may be held in place by the yoke mounting pin 34 as hereinafter described being inserted through top holes in each into the interior cavity of the top segment 14.

The embodiment shown in FIGS. 1 through 4 includes a support yoke 26, which may be removeably positioned atop the upper support segment 14 by means of a mounting pin 34 that is secured to it by means of mounting pin bolt 36 and nut 38. The pin 34 is configured and dimensioned to conform closely to the configuration and dimensions of the inside of the upper segment 14 so as to provide a juncture therewith which is readily removeable and at the same time substantially wobble-free. Thus, as shown, it is cylindrical and of only slightly smaller diameter than the inside diameter of the tube which forms the upper support segment 14. Of course, if the segment 14 were of a cross-sectional configuration other than round (e.g., square, rectangular, etc.), the mounting pin 34 would be correspondingly dimensioned and configured.

The mounting yoke 26 is configured to provide dual arms vertically oriented from a base element to describe an upward opening continuum. As shown, the yoke 26 is semi-circular, because this has proved to be an advantageous configuration in terms of ease to produce, strength, appearance, and cooperative use with a basin support 28 which, as hereinafter described, is circular so as to be adapted to accomodate basins of standard and common sizes and configurations. However, other yoke configurations are within the comtemplation of this invention, including segments of regular arcuate geometric shapes, such as the lower half of an ellipse oriented with the long axis horizontal, or open top polylaterals, such as squares or rectangles. The important feature of such structures is that they present upward extending arms which are spaced further apart at the topmost ends than at the base to pivotally mount a basin support, as hereinafter described, so that the basin support may be revolved freely about the axis described by the ficticious line connecting the pivot mountings on the upper ends of the arms.

Positioned between the upper ends of the arms of the support yoke 26 and pivotally mounted thereto is a basin support 28, shown as being circular in cross-section to provide surfaces which dimensionally and in configuration correspond to those of the yoke 26. It is possible to mix shapes as between the support yoke and the basin support, as by using a circular basin support with a square yoke, but usually it is desirable for the two to be comparably configured. Most desirably the basin support is round to adapt it to standard basin configurations. The basin support may be revolved freely about the axis between the yoke arm ends by means of support pins 40, 42, and may be positionally fixed as to orientation with respect to the yoke by means of wings nuts 32, 33.

By this means, as will be apparent from FIG. 2, the basin suppoet 28 may be positionally fixed in a horizontal attitude to receive and hold a basin 30 or, as will be apparent from FIG. 4, the basin support may be positioned so that it is coplanar with the support yoke 26 to facilitate packing when not in use.

In use, as shown in FIGS. 1 and 2, the various components may be assembled with the support pole members 12, 14 engaged with each other, with member 12 engaged with the mounting pin 15 atop the base 14 or thrust into the earth as shown in FIG. 5, and with the soap dispenser holder 18, the towel holder 24, and the support yoke 26 affixed to the top of member 14 by means of mounting pin 34. These last relationships are illustrated in greater detail in cross-section as shown in FIG. 3.

When this embodiment is not in use and it is desired to dis-assemble it for storage and/or transporation from one location to another, as shown in FIG. 4 the various components may be disassociated from each other into convenient sized pieces. In particular, it should be noted that the basin support 28 may be revolved in its support yoke 26 so that the two are co-planar. This minimizes the space occupied by them without the necessity for dis-assembling them totally from each other with consequent risk of loss of loose or small parts.

It should be noted particularly that because of the unique structural features of the support yoke-basin support elements vis-a-vis the support pole members 12, 14, it is possible to achieve the foregoing objectives while, at the same time, making possible a portable wash stand assembly which is unusually stable against tipping over. The reason for this is because this unique structure enables the center of gravity of the assemblage, particularly when the basin 30 is comparatively heavily weighted by virtue of water being placed in it, to be maintained substantially concentric with the axis of the support pole members 12, 14. Thus, even though the soap and towel holders are centered somewhat off that axis and therefore provide some moments of force that tend toward tipping, they are too miniscule to be significant, particularly compared to the weight and lateral diminsions of the basin and especially when it is filled with water. Thus, it is possible, through practice of the present invention, to achieve the weight "centering" for positional stability which a survey of the prior arts indicates is a long sought-after result. At the same time, one may also achieve the other long sought-after results of compactness and ease of dis-assembly. The structural features of the present invention which enable it to achieve these results simultaneously set it apart from prior art attempts.

Accordingly, it is to be understood that the embodiments of this invention herein described are by way of illustration and not of limitation, and that a wide variety of embodiments may be made without departing from the spirit or scope of this invention.

I claim:

1. A portable wash stand device comprising a vertical support having at least one constituent member and a base means adapted to impart positional stability to said device on, and removeable affixation of it to, the surface of which it is to be used, and a basin support means which is adapted for removeable affixation to the top of said vertical support in the form of a substantially semi-circular upward facing yoke oriented with the pivot line described by its top-most ends passing through and normal to the axis of said vertical support and has a circular basin support member whose outside diameter is slightly less than the inside diameter of said semi circle and is pivotally affixed to the top-most ends of said yoke with said pivot line passing through the center of the points of said pivotal affixation and describing a diameter of said circle, and means for pivotally affixing the position of said basin support member with respect to said yoke.

2. The device described in claim 1 wherein the adaptation of said base means of said vertical support comprises forming said support from a hollow tube and forming its base at an angle whereby the support may be positioned atop a base plate having an upward oriented mounting pin to reside within the hollow interior of said support and may also be thrust vertically downward into the surface of the earth.

3. The device described in claim 2 including a soap dispenser holder means and a towel support means which are removeably affixed to the top of said support by means of a mounting pin projecting downward from the base of said yoke, positioned in an interior upward facing cavity of corresponding configuration and dimension in the top of said support.

4. The device described in claim 2 including a soap dispenser holder means and a towel support means which are removeably affixed to the top of said support by means of a mounting pin projecting downward from the base of said yoke, positioned in an interior upward facing cavity of corresponding configuration and dimension in the top of said support and wherein the adaptation of said base means of said vertical support comprises forming said support from a hollow tube and forming its base at an angle whereby the support maybe positioned atop a base plate having an upward oriented mounting pin to reside within the hollow interior of said support and may also be thrust vertically downward into the surface of the earth.

5. In a portable wash stand having a vertical support member, a wash basin receptacle device comprising a support yoke having a base member adapted for removeable affixation to the top of said support member and two upwardly extending arms the center-lines of which, when said yoke is so affixed to the top of said support, together with the axis of said vertical support member, occupy the same imaginary flat plane, and a basin support member which is in the form of a closed geometric figure, opposite sides of which are pivotally affixed to the inside of said arms at their top-most ends, and is so shaped and configured that it may be pivoted through 360° about the points of said pivotal affixation without coming into contact with said support yoke, said device including means to affix the pivotal position of said basin support member with respect to said support yoke.

6. The device described in claim 5 wherein the geometric figure of said basin support member is a regular arcuate geometric figure.

7. The device described in claim 6 wherein the geometric figure of said basin support member is a circle.

8. The device described in claims 5, 6, or 7 wherein the geometric figure of said yoke is a portion of a regular arcuate geometric figure.

9. The device described in claims 5, 6, or 7 wherein the geometric figure of said yoke is not more than one-half of the circumference of a circle.

10. The device described in claims 5, 6, or 7, wherein the geometric figure of said yoke is a semi-circle.

* * * * *